US005081948A

United States Patent [19]

Walsh

[11] Patent Number: 5,081,948

[45] Date of Patent: Jan. 21, 1992

[54] BOOKMARK

[76] Inventor: James B. Walsh, 509 Madison Ave., New York, N.Y. 10022

[21] Appl. No.: 710,102

[22] Filed: Jun. 4, 1991

[51] Int. Cl.[5] ..... B42D 9/00

[52] U.S. Cl. ..... 116/235; 116/240; 116/323

[58] Field of Search ..... 116/235, 234, 240, 236, 116/237, 238, 239, 321, 322, 323; 281/42

[56] References Cited

U.S. PATENT DOCUMENTS

| | | | |
|---|---|---|---|
| 399,768 | 3/1889 | Mehrer | 116/235 |
| 446,857 | 2/1891 | Fiske | 116/235 |
| 922,110 | 5/1909 | Eberle | 116/238 |
| 1,232,116 | 7/1917 | Stechan | 116/236 |
| 1,497,955 | 6/1924 | Stevens | 116/234 X |
| 2,543,182 | 2/1951 | Lang | 116/235 |
| 2,630,777 | 3/1953 | Johnson | 116/235 |
| 2,953,115 | 9/1960 | Haskins | 116/235 |
| 2,964,010 | 12/1960 | Harrison | 116/234 |
| 3,266,456 | 8/1966 | O'Reilly | 116/235 |
| 4,901,665 | 2/1990 | Carlin | 116/240 X |

FOREIGN PATENT DOCUMENTS

| | | | |
|---|---|---|---|
| 2485442 | 12/1981 | France | 116/235 |
| 0667623 | 10/1988 | Switzerland | 116/234 |
| 2222387 | 3/1990 | United Kingdom | 116/234 |

*Primary Examiner*—William A. Cuchlinski, Jr.
*Assistant Examiner*—John L. Beres
*Attorney, Agent, or Firm*—Lerner, David, Littenberg, Krumholz & Mentlik

[57] ABSTRACT

A bookmark that locates a particular page in a book and a specific line on that page includes a body having an elongated slot with an indicator rotatably and slidably mounted in the slot to identify the desired page and line. On one side of the bookmark the indicator includes indicia which point in one direction and on the other side of the bookmark the indicator includes indicia which point in an opposite direction so that no matter which side of the bookmark faces a reader when the book is opened, the indicia will always point to the desired page and line.

4 Claims, 3 Drawing Sheets

BOOKMARK

FIELD OF THE INVENTION

The present invention relates to bookmarks, and more particularly to bookmarks capable of returning a reader not only to the desired page, but also to a specific line on that page.

BACKGROUND OF THE INVENTION

Bookmarks have long been rather simple devices which help a reader locate a particular page in a book. More recently, however, bookmarks have become more sophisticated, incorporating features which identify a specific column on a page, and even a particular line in that column. In one such bookmark, disclosed in U.S. Pat. No. 3,266,456 to O'Rielly, an indicating arrow is rotatably and slidably mounted in a slot in the center of the bookmark. The bookmark is first placed on the desired page and the arrow rotated to face towards either the right or the left to thus indicate the desired column. The arrow is then slid either upwardly or downwardly in the slot to align with a particular line. Another such bookmark, disclosed in U.S. Pat. No. 4,901,665 to Carlin, includes two sets of indicia one of which represents either the right-hand or left-hand page and the other of which represents the desired column on that page, and a sliding indicator which locates a particular line of text. The bookmark is used by first orienting same so that the indicia which represent the desired page and column are at the upper portion of the right-hand page. The indicator is then slid into alignment with a particular line on that desired page and column.

All of the page and line indicating bookmarks which have been devised to date, including those described above, must lie on the page on which they were first placed when the book is later reopened. For example, in the case of the Carlin bookmark, if the book is opened with the bookmark lying on the left-hand page, the indicia facing the reader will indicate the wrong page and column. When a bookmark is inserted to mark a page near the front of a book, the bookmark will typically fall to the right-hand page when the book rs opened. On the other hand, when the bookmark is inserted to mark a page near the back of the book, the bookmark will typically fall to the left-hand page when the book is opened. In view of the foregoing, the page and line indicating bookmarks which have heretofore been available will not function properly throughout the entire book.

There therefore exists a need for an improved bookmark which will indicate the desired page as well as the desired line on that page no matter which side of the bookmark faces upwardly when the book is opened.

SUMMARY OF THE INVENTION

These needs have now been addressed by the invention of a bookmark for indicating an exact line and page in a book consisting of a body having a first face and a second face opposite the first face and a first edge and a second edge opposite the first edge. An indicating means is slidably mounted to the body for movement in directions generally parallel to the edges for indicating a particular page and line on the page, the indicating means having first indicia disposed adjacent the first face of the body and second indicia disposed adjacent the second face of the body, the first and second indicia pointing in opposite directions so that when the first indicia points toward the first edge of the body the second indicia points toward the second edge of the body.

In accordance with one embodiment of the bookmark of the present invention, the indicating means is rotatably mounted to the body so that, upon rotation of the indicating means, the first indicia may be oriented to point toward either the first or second edge of the body. In preferred embodiments of the bookmark, the indicating means is slidably and rotatably disposed in an elongated slot provided in the body.

In another embodiment of the present invention, the bookmark further includes ribbon means secured to an end of the body for protruding to mark a place in the book when the book is closed.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
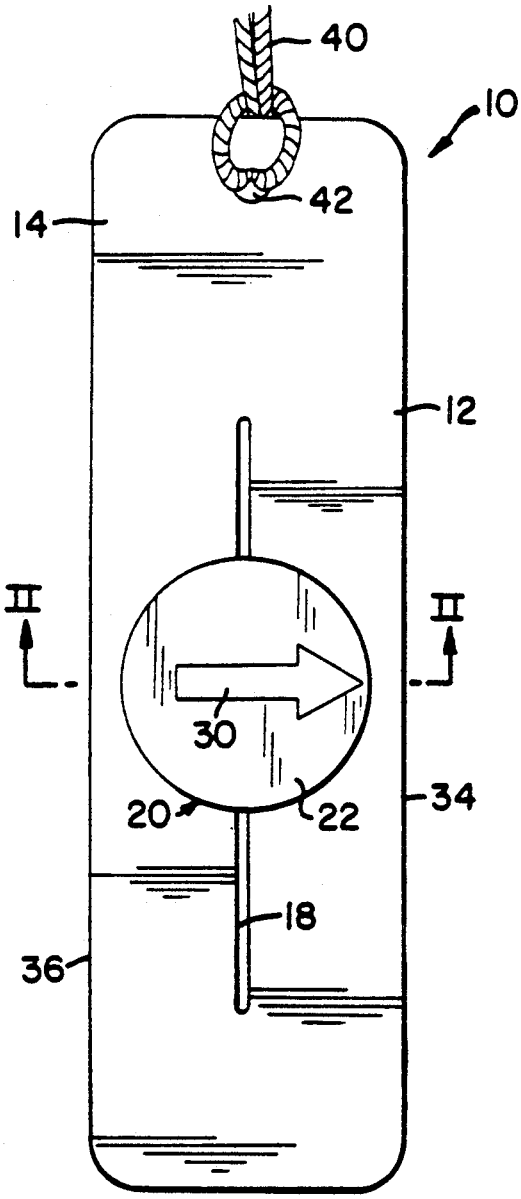
FIG. 1 is a plan view of one embodiment of the bookmark of the present invention.
Figure 2:
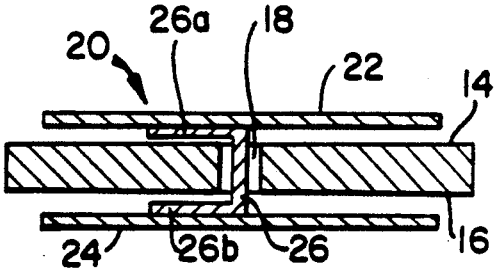
FIG. 2 is a sectional view of the bookmark taken along line II—II of FIG. 1.
Figure 3:
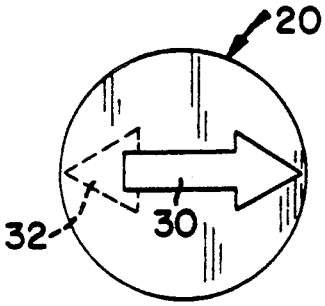
FIG. 3 is a plan view of the slider portion of the bookmark of FIG. 1 showing the indicating arrow on one side thereof in solid lines and the indicating arrow on the opposite side in dashed lines.

Referring to the Figures, there is illustrated a preferred embodiment of a bookmark 10 in accordance with the present invention. Bookmark 10 consists of a body 12 having a front face 14 and a back face 16 with a elongated slot 18 disposed longitudinally in the center thereof. A slider 20, disposed for rotation and longitudinal displacement in slot 18, includes a first indicating member 22 arranged adjacent front face 14 of body 12 and another indicating member 24 arranged adjacent the back face 16 of body 12. Indicating members 22 and 24 are operatively connected to one another by a rigid connecting member 26 having a U-shaped configuration including leg portions **26*a* and 26*b*. Thus, indicating member 22 is glued or otherwise secured to leg portion 26*a* while indicating member 24 is similarly secured to leg portion 26*b*. The exposed faces of indicating members 22 and 24 each have an arrow or other indicia capable of pointing to a particular line on a page, the arrow or other indicia 30 on indicating member 22 pointing in the opposite direotion to the arrow or other indicia 32 on indicating member 24. That is, when arrow 30 is pointing towards longitudinal edge 34 of body 12, arrow 32 will be pointing towards the opposite longitudinal edge 36 of body 12 so that, no matter which one of indicating members 22 or 24** faces the reader, the arrow thereon will always point in the same direction.

Figure 4:
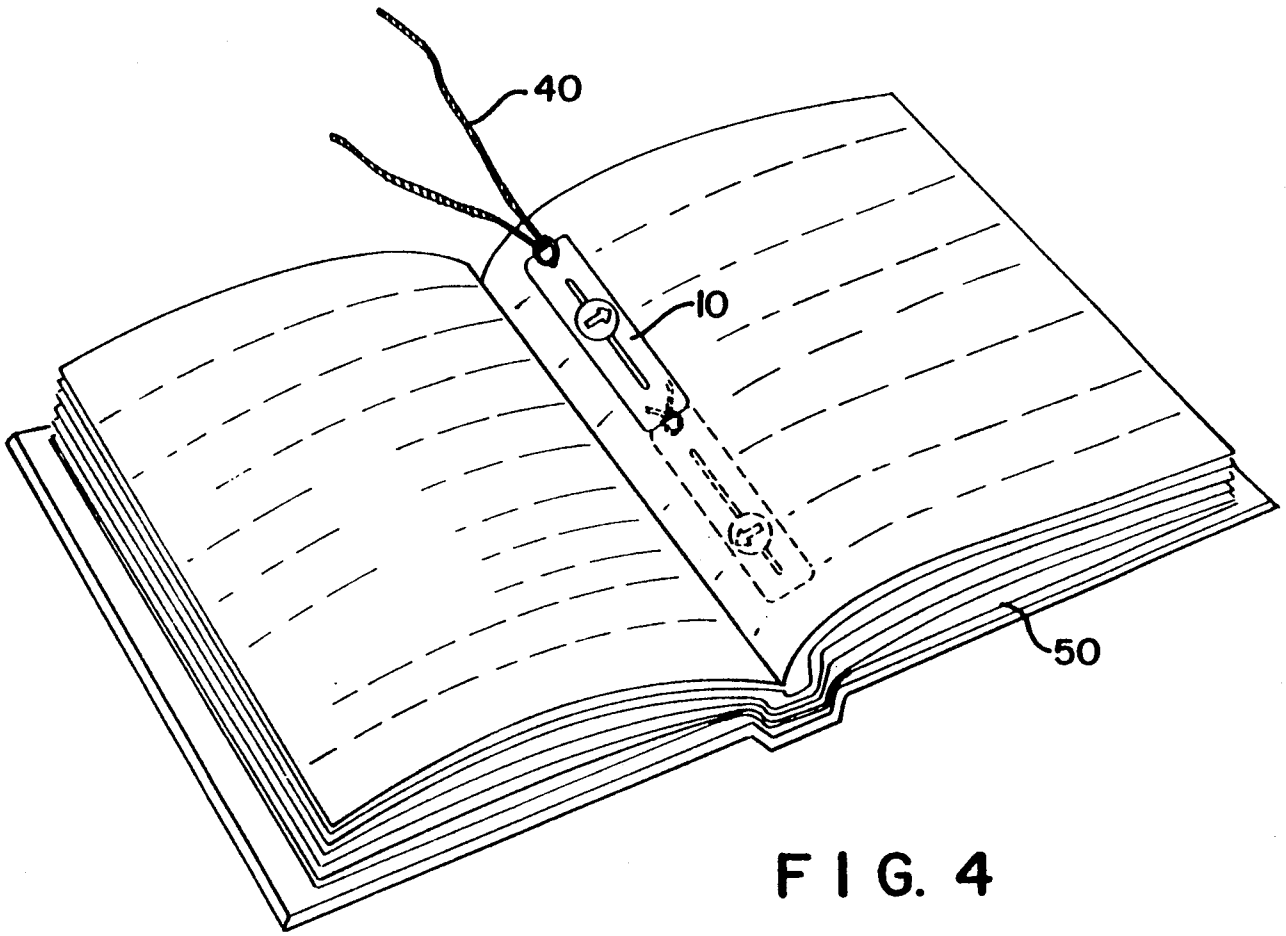
FIG. 4 is a perspective view of an open book marked with the bookmark shown in FIG. 1.

In order to use the bookmark 10 of the present invention to identify a specific page and line in a book, slider 20 is first rotated so that the arrow facing the reader is pointing towards the desired page, ie. either the left-hand page or the right-hand page. Thus, assuming the reader desires to mark a line on the right-hand page and front face 14 of bookmark 10 is facing the reader, slider 20 will be rotated until arrow 30 faces towards the right. Bookmark 10 is then placed in the book 50 so that body 12 lies in the general region of the line to be marked. For example, if the line to be marked lies at the top of the page, body 12 is positioned to lie generally towards the top of book 50 as shown in solid lines in FIG. 4, and if the line to be marked lies near the bottom of the page, body 12 is positioned to lie near the bottom of book 50 as shown in FIG. 4 in dashed lines. Finally, slider 20 is vertically adjusted until arrow 30 points to the desired line and the book is closed.

For larger books, where the body 12 of the bookmark 10 will not extend beyond the page of the book when the book is closed, a ribbon 40 connected to an aperture 42 at one end of the body 12 is positioned so that it extends beyond the edge of the page and thus returns the reader to the desired page when the book has been closed.

Depending on how the book is opened when the reader returns, bookmark 10 may fall against either the left-hand page or the right-hand page. Continuing the example above, if the bookmark 10 falls against the right-hand page it will be exactly as it had been positioned when closing the book. In other words, front face 14 will be facing the reader and arrow 30 will be pointing to the desired line on the right-hand page. On the other hand, the bookmark 10 may fall against the left-hand page when the book is opened so that back face 16 is facing the reader. In this case, arrow 32 will be visible, but will still point to the right-hand page and the desired line thereon.

Figure 5:
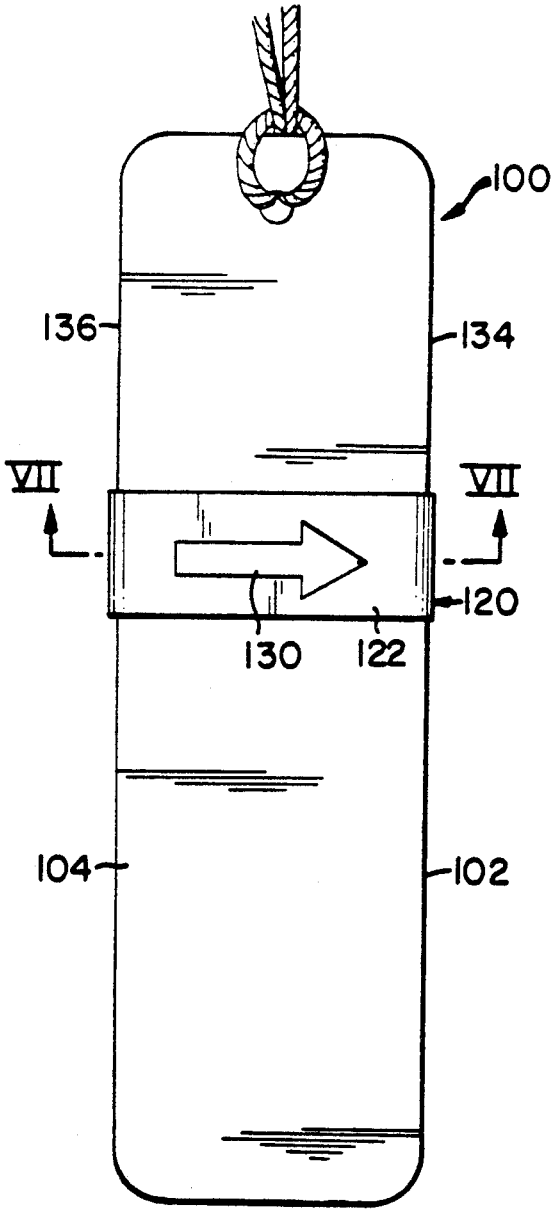
FIG. 5 is a plan view of an alternate embodiment of the bookmark of the present invention.
Figure 6:
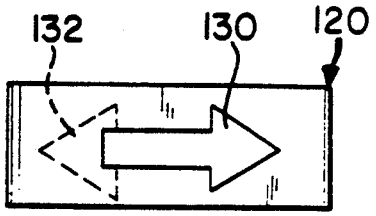
FIG. 6 is a plan view of the sleeve portion of the bookmark of FIG. 5 showing the indicating arrow on one side thereof in solid lines and the indicating arrow on the opposite side in dashed lines.
Figure 7:
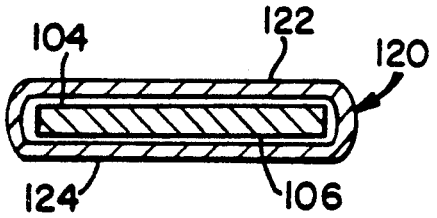
FIG. 7 is a sectional view of the bookmark taken along line VII—VII of FIG. 5.

An alternate embodiment of the bookmark in accordance with the present invention is shown in FIGS. 5–7. In accordance with this embodiment, a bookmark 100 consists of a body 102 having a front face 104 and a back face 106. A sleeve 120, assembled around body 102 and longitudinally displaceable therealong, includes a first surface 122 adjacent front face 104 of body 102 and another surface 124 adjacent the back face 106 of body 102. Surfaces 122 and 124 each have an arrow or other indicia capable of pointing to a particular line on a page, the arrow or other indicia 130 on surface 122 pointing in the opposite direction to the arrow or other indicia 132 on surface 124. In other words, when arrow 130 is pointing towards longitudinal edge 134 of body 102, arrow 132 will be pointing towards the opposite longitudinal edge 136 of body 102 so that, no matter which one of surfaces 122 or 124 faces the reader, the arrow thereon will always point in the same direction.

The bookmark 100 in accordance with this embodiment of the present invention is used in essentially the same manner a bookmark 10 of the previously described embodiment to identify a particular page and line in a book. Thus, the arrow facing the reader is first oriented to face towards either the left-hand page or the right-hand page, whichever is desired. In this embodiment, however, the direction in which the arrow points is changed by removing sleeve 120 from body 102, turning it upside down, and reassembling it onto body 102. Bookmark 100 is then placed in a book as described above and sleeve 120 is vertically adjusted until the visible arrow is aligned with the line to be marked, after which the book is closed. Again, regardless of which page the bookmark 100 falls against as the book is opened, the arrow visible to the reader will point toward the desired page and line thereon.

Although the invention herein has been described with reference to particular embodiments, it is to be understood that these embodiments are merely illustrative of the principals and applications of the present invention. It is therefore to be understood that numerous modifications may be made to the illustrative embodiments and that other arrangements may be devised without departing from the spirit and scope of the present invention as set forth in the appended claims.

I claim:

1. A bookmark for indicating an exact line and page in a book, comprising a body having a first face, a second face opposite said first face, a first edge and a second edge opposite said first edge, indicating means mounted to said body for movement in directions generally parallel to said edges for indicating a particular page and line on said page, said indicating means having first indicia disposed adjacent said first face of said body and second indicia disposed adjacent said second face of said body, said first and second indicia pointing in opposite directions so that when said first indicia points toward said first edge of said body, said second indicia points toward said second edge of said body.

2. The bookmark as claimed in claim 1 wherein said indicating means is rotatably mounted to said body so that, upon rotation of said indicating means, said first indicia may be oriented to point toward either said first or second edge of said body.

3. The bookmark as claimed in claim 2 further comprising an elongated slot disposed in said body, wherein said indicating means is slidably and rotatably disposed in said slot.

4. The bookmark as claimed in claim 1 further comprising ribbon means secured to an end of said body for protruding to mark a place in said book when said book is closed.

* * * * *